US006164950A

United States Patent [19]

Barbier et al.

[11] Patent Number: 6,164,950

[45] Date of Patent: Dec. 26, 2000

[54] DEVICE FOR PRODUCING SPUNBONDED NONWOVENS

[75] Inventors: Detlef Barbier, Waldfischbach-Burgalben; Engelbert Löcher, Worms; Norbert Goffing, Neunkirchen, all of Germany; Jean Baravian, Sundhoffen, France; Peter Pförtner, Raleigh, N.C.; Georges Riboulet, Colmar, France; Milton Williams, Durham, N.C.

[73] Assignee: Firma Carl Freudenberg, Weinheim, Germany

[21] Appl. No.: 09/227,620

[22] Filed: Jan. 8, 1999

[51] Int. Cl.[7] ..... B29C 47/00

[52] U.S. Cl. ..... 425/378.2; 425/382.2; 425/463

[58] Field of Search ..... 425/382.2, 72.2, 425/131.5, 378.2, 463

[56] References Cited

U.S. PATENT DOCUMENTS

| | | | |
|---|---|---|---|
| 3,433,857 | 3/1969 | Dutton, Jr. et al. | 264/441 |
| 3,659,989 | 5/1972 | Uraya et al. | 425/131 |
| 3,861,843 | 1/1975 | Keuchel et al. | 425/198 |
| 4,118,163 | 10/1978 | Keuchel et al. | 425/198 |
| 4,303,382 | 12/1981 | Gellert | 425/566 |
| 4,437,827 | 3/1984 | Moderlak et al. | 425/378 S |
| 4,518,658 | 5/1985 | Baravian et al. | 428/291 |
| 5,160,746 | 11/1992 | Dodge, II et al. | 425/7 |
| 5,352,106 | 10/1994 | Lenk et al. | 425/131.5 |
| 5,476,616 | 12/1995 | Schwarz | 264/6 |
| 5,511,960 | 4/1996 | Terakawa et al. | 425/7 |
| 5,624,740 | 4/1997 | Nakata | 428/204 |
| 5,798,125 | 8/1998 | Zikeli et al. | 425/72.2 |

FOREIGN PATENT DOCUMENTS

| | | |
|---|---|---|
| 34 19 675 | 11/1984 | Germany . |
| 50 014873 | 2/1975 | Japan . |
| 446 605 | 3/1968 | Switzerland . |
| 1055187 | 1/1967 | United Kingdom . |

*Primary Examiner*—James P. Mackey
*Assistant Examiner*—Joseph S Del Sole
*Attorney, Agent, or Firm*—Kenyon & Kenyon

[57] ABSTRACT

Rectangular or round spinning nozzle packs for extruding thermoplastic filaments each have both melt channels and orifices for the higher melting polymer compound and also melt channels with orifices through which is passed a polymer compound that melts at a temperature 5 to 50° C. lower. Variously designed insulation channels thermally separate these melt channels, which are operated at different temperatures.

18 Claims, 5 Drawing Sheets

DEVICE FOR PRODUCING SPUNBONDED NONWOVENS

BACKGROUND OF THE INVENTION

The present invention relates to a device for producing spunbonded nonwovens, i.e., flat webs formed by a plurality of continuous filaments. These filaments are formed by spinning or extruding molten plastics in devices containing a plurality of nozzles in which the plastic is shaped into filaments and discharged. The cohesion of the spunbonded nonwovens is explained by the more or less strong bonding of the filaments to one another at their points of intersection.

The present invention is concerned in particular with spinning nozzle packs for production of spunbonded nonwovens. These nonwovens have two continuous filaments that are different at least with respect to their melting range and are bonded by heat. These filaments are formed by simultaneously extruding two polymers with different melting ranges and then depositing them in an intermingled arrangement on a flat surface.

The resulting flat web is heated in the next operation to a temperature sufficient to soften only one type of filament, so that an adhesive bond is formed at all points of intersection of the two types of filament and at the points of intersection of the lower melting filaments with one another after cooling. The filaments with the lower melting range thus play the role of a binder.

Devices for producing spunbonded nonwovens are described in German Patent No. 34 19 675 C2. Spunbonded nonwovens are produced for use as carriers, optionally coated with bitumen, for all large-area sealing functions in the construction industry because of their stability. Their design is characterized by two types of thermally bonded continuous filaments. One type is formed by very high-melting polyethylene glycol terephthalate and is present in the nonwoven in the amount of 70 to 90 wt %, while the other type is formed by polybutylene glycol terephthalate and is present in the amount of 30 to 10 wt % and plays the role of the binder, because its melting point is only about 225° C. For both types of filament, single filament titers of 4.5 to 6.5 dtex are reported.

The nonwoven is produced by extruding the two types of molten polymer for the respective filaments through spinning nozzles arranged side by side, with one spinning nozzle being assigned to one type of polymer physically and with regard to the material and temperature program. The spun filament bundles are drawn pneumatically from one side beneath the spinning nozzles and strike a baffle plate or guide plate which makes it possible to open the bundle. Then the filaments drop onto a continuous lattice apron. As an alternative, they can be combined and only then drawn together pneumatically. This yields an especially good and thorough mixing of the two types of filaments.

Continuous deposition is preferably followed by a needling operation and then thermal calendering, likewise performed continuously. The flat web then passes through the linear gap between two cylindrical rolls, at least one of which is heated. To do so, a temperature is selected that softens only the lower melting filaments to such an extent that they become capable of binding to the filament intersection points as described above. This is followed by an operation in which the solidified flat web is cooled between cooling cylinders and then wound up. In this stage, the finished nonwovens according to German Patent No. 34 19 675 C2 have a weight per unit area of 100 to 180 g/m$^2$.

With the simultaneous extrusion of matrix filaments and binding filaments and processing according to the above teaching, flexible flat webs with a good dimensional stability are obtained. Integration of the operation of continuous thermal bonding permits economic production: thermal bonding reduces energy costs in production to about ⅛ in comparison with chemical bonding. According to German Patent No. 34 19 675 C2, the values for tensile strength and elongation at break in the various directions parallel to the plane of the nonwoven are close together.

These advantages must be seen against the requirement of having to use separate spinning nozzles with individual product and temperature programs for each type of filament (high melting matrix component, low melting bonding component). The space required for each individual nozzle, which has a lower limit because of the limited possibility of minimizing nozzle dimensions, also leads to a lower limit for the distance between the extruded filaments directly downstream from the nozzle outlet. Thus, there is also an upper limit for the specific throughput of spinnable material per unit of area of the device, i.e., within each spinning beam.

Especially when the filament titers differ greatly, the distance between matrix filament and binding filament, which cannot be further reduced, leads to fluctuations in their quantity ratios in the deposited nonwoven. This results in zones with higher and lower amounts of binding filament, which is reflected in corresponding unwanted fluctuations in the mechanical properties of the flat web. In this regard, the applicability of the teaching from German Patent No. 34 19 675 C2 is limited to matrix filaments and binding filaments of the same titer.

SUMMARY OF THE INVENTION

In view of the preceding discussion, the object of the present invention is to improve upon the related art discussed above with regard to the following criteria:

- It should also be possible to extrude matrix filaments and binding filaments whose polymer characteristics also differ greatly with a smaller distance between them, with a higher specific throughput per spinning beam than permitted by the individual geometry of the individual nozzles. This should yield a more intense mixing of the two types of filaments in deposition.
- The different polymer characteristics of the spinnable material and the filaments should be selectable at least with regard to the parameters for the melting range and the titers within a wider range than is possible with the related art according to German Patent No. 34 19 675 C2 (these values are given in parentheses below): melting range of binding filaments: 125° to 245° C. (225° C.) matrix/binding filament titer ratio: 1:1 to 1:10 (1:1) weight per unit of area of the finished nonwoven: 5 to 500 g/m$^2$ (100 to 180 g/m$^2$)
- According to the related art, the amount by weight of the binding filaments in relation to the matrix filaments should be 5% to 50% (10% to 30%).
- In any case, in implementation of the above requirements, the ratio of matrix fibers to binding fibers after deposition to form a nonwoven should be very uniform in all areas and in all parts of the cross section.

The requirement for extremely different titers arises in particular with applications where numerous small, weaker bonding points between matrix fibers and binding fibers is important. One such noteworthy example is in backings for carpets, where the fibers must be flexible enough in the tufting operation but at the same time capable of producing such a good adhesive bond in the finished carpet that there are no loose fibers.

Another example is roofing sheet backings, which are exposed to temperatures of up to 220° C. when asphalt is applied and are under tensile stress under these conditions. Their longitudinal elongation in the direction of stress must not exceed 5% of the starting value.

High values of 200° C. to 245° C. for the melting range of the binding filaments are necessary for nonwovens which must not lose their strength even at higher ambient temperatures, such as sound absorbing nonwovens in the engine compartment of motor vehicles or again roofing sheet backings.

Lower values of 125° C. to 180° C. for the melting range of the binding filaments are to be preferred when a carpet backing is to be deformed at low temperatures so as not to destroy the pile yarn of the finished carpet on the one hand while on the other hand reducing cycle times and thus reducing costs.

This object is achieved according to the present invention by providing and operating spinning nozzles which are each individually capable of spinning two types of thermoplastic polymers to filaments with different titers and with melting temperatures that differ by 5° C. to 50° C.

To guarantee optimum temperature management for each type of polymer, i.e., the lower melting bonding component and the higher melting matrix component, for establishing the respective melting range, spacings are provided between the spinning nozzle apertures for the individual types of polymers that are thermally separated from one another. This separation can be achieved with thermal insulation material between the apertures. As an alternative, air-filled cavities running parallel to the apertures may be provided between the apertures, with air being the insulation material here.

The spacings of the apertures through which the different polymers flow and the choice of the solid or air insulation material depend on the specific different melting points of the two types of polymers. A number of easy-to-perform (and necessary) preliminary tests are performed in order to establish the optimum temperature program for both polymers, adapted to the respective melting point. Of course, the melting point difference in particular plays a role here.

Examples of solid insulation materials include ceramic materials or glass cloth mats impregnated with a phenolic resin or epoxy resin and then cured.

If the matrix fibers and binding fibers are to have different titers, the cross section of the apertures for producing the finer fibers must of course be so small that a lower throughput and thus finer filaments are achieved than those of the higher titer filaments extruded at the same time.

The advantage of the present invention is that for the first time many filaments which are different with regard to type of polymer and melting point can be extruded in a very small space. Thus there is a premixing of the fiber types shortly after exiting through the orifice, thus eliminating the need for downstream mixing devices for the extruded filaments. This also prevents separation at a greater distance from the spinning nozzles.

Furthermore, the present invention makes it possible for the first time to combine the spinning masses spatially in the nozzle and thereby increase the throughput of a spinning beam equipped with a plurality of such nozzles up to as much as twofold. In the past the only known method of achieving an increased throughput was to increase the flow of material, which resulted in considerable problems, such as bundling of fibers and poor cooling of fibers.

One unforseen consequence of this approach is that using the spinning nozzles according to the present invention would lead to interactions between matrix filaments and binding filaments below the nozzles after leaving the orifice. The speeds of the two types of filaments evidently become more alike after leaving the orifices, so that very smooth fiber travel is observed until deposition.

BRIEF DESCRIPTION OF THE DRAWINGS

An example of a structural design of the spinning nozzles constructed according to the principles of the present invention is illustrated in FIGS. 1 through 5, in which.

DETAILED DESCRIPTION

Figure 1A:
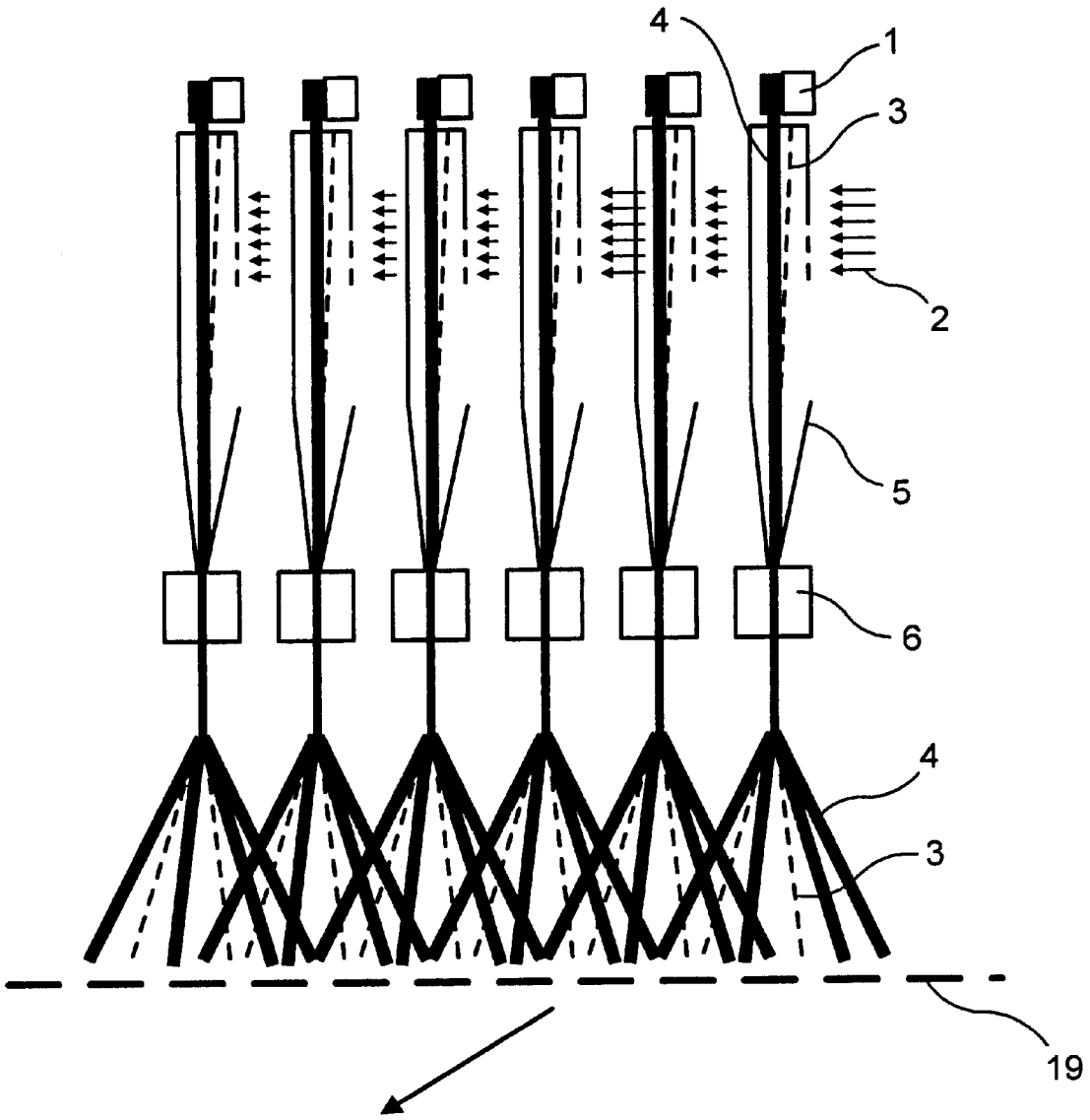
FIG. 1*a* is a schematic side view of the basic arrangement of a spinning station group.

FIG. 1*a* presents a side view of the arrangement of a spinning station group, beginning from above with spinning nozzle pack 1 and cooling air 2 blown across the direction of spinning. The high melting matrix filament is labeled as 3 and the low melting binding filament is 4. Both filaments pass through a drawing element 5 and then enter a cooling cabinet 6. Both types of filament 3 and 4 are discharged from the cabinet, spreading out in a conical pattern, and deposited on a deposition belt 19 moving horizontally in the direction of the arrow. Deposition of the filaments on the belt can be further improved by suction devices beneath the belt. The arrow demonstrates the direction of travel of the deposition belt perpendicular to the plane of the drawing.

Figure 1B:
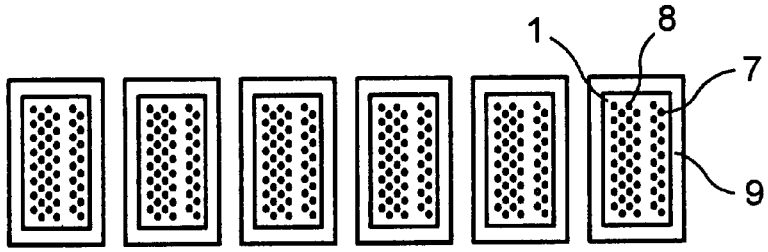
FIG. 1*b* is a lower plan view of the corresponding nozzle packs.

FIG. 1*b* shows a view of the spinning nozzle packs 1 from below. This figure shows orifices 7 for the binding filaments and orifices 8 for the matrix filaments as well as heating box 9.

Figure 2A:
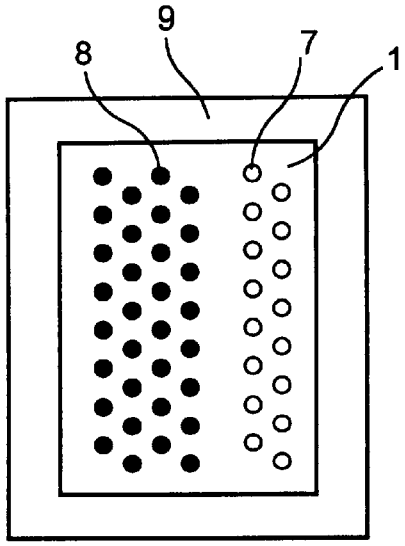
FIGS. 2*a* through 2*d* show different hole arrangements for round and rectangular spinning nozzle packs.
Figure 2B:
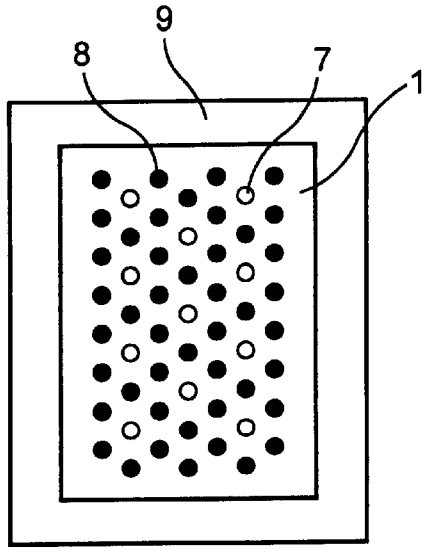

FIGS. 2*a* and 2*b* show different arrangements for the orifices for the filaments with rectangular spinning nozzle packs. The orifices for the binding filaments are again labeled as 7 and those for the matrix filaments are shown as 8. Each spinning nozzle pack 1 is surrounded by a heating box 9. The similar diagrams in FIGS. 2*c* and d show embodiments of round spinning nozzle packs 1.

Figure 2C:
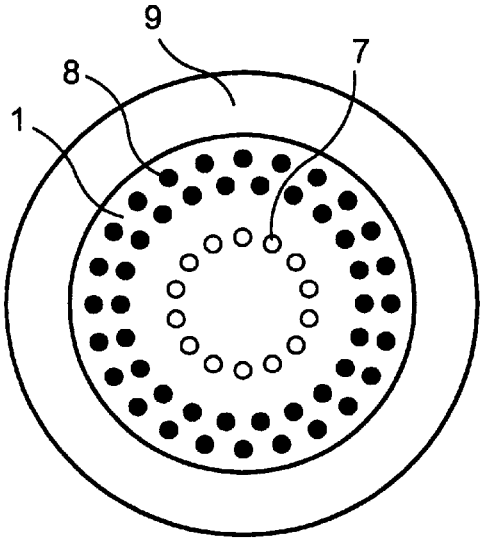
Figure 2D:
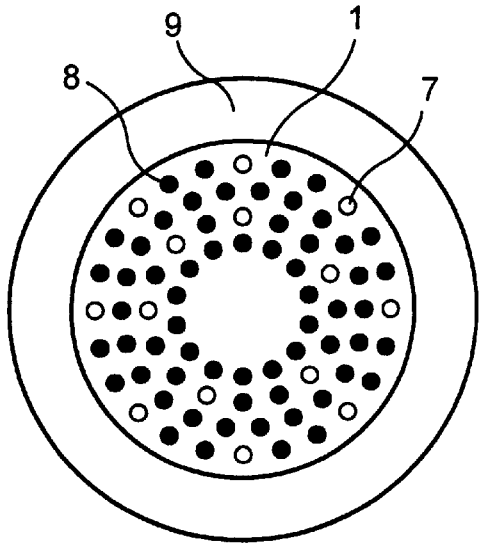

In FIGS. 2*a* and 2*c*, orifices 7 and 8 are arranged in groups, namely forming rows that are separated according to the substance extruded in variant a, and forming concentric circles separated according to the substance extruded in variant c. FIGS. 2*b* and d show a uniform distribution of orifices 7 and 8 mixed together.

Figure 3A:
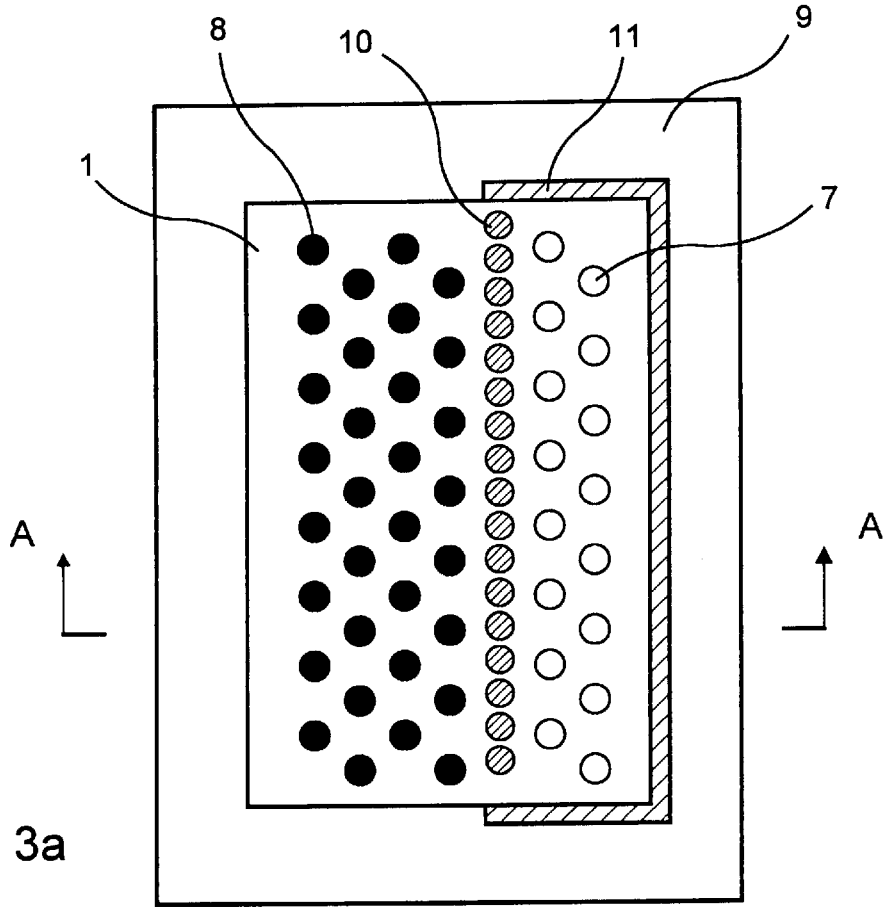
FIGS. 3*a* and 3*b* illustrate possible arrangements for the position of insulation between the spinning nozzle apertures.

FIG. 3*a* shows a spinning nozzle pack 1 from below, containing orifices 8 for the matrix filaments and orifices 7 for the binding filaments. The heating box is again labeled as 9. Insulation orifices 10 are located between the melt channels for the matrix filaments and those for the binding filaments; furthermore, the channels (only the orifices can be seen from below) for the binding filaments are surrounded by an insulating gap 11. The insulation material in cavities 10 and 11 may be a solid material; however, an air filling is also possible. Insulation gap 11 serves to reduce the heat flow from heating box 9 to the melt channels.

Figure 3B:
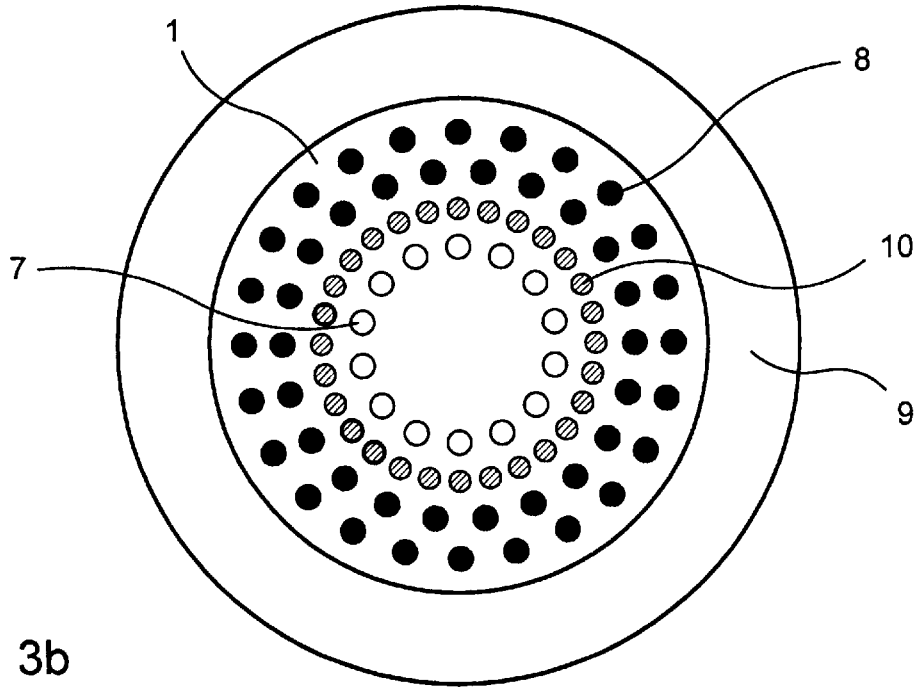

FIG. 3*b* shows a similar arrangement with a round nozzle having concentric orifices 7 and 8. This design eliminates the need for an additional insulation gap according to FIG. 3*a* because orifices 7 for the binding filaments are arranged at a great enough linear distance from heating box 9, which is cylindrical here, and are also insulated from it due to the positioning of the melt channels and orifices 8 for the matrix filaments.

Insulating cavities 10 and 11 are arranged in the nozzle so that there is no loss of mechanical stability.

Figure 4A:
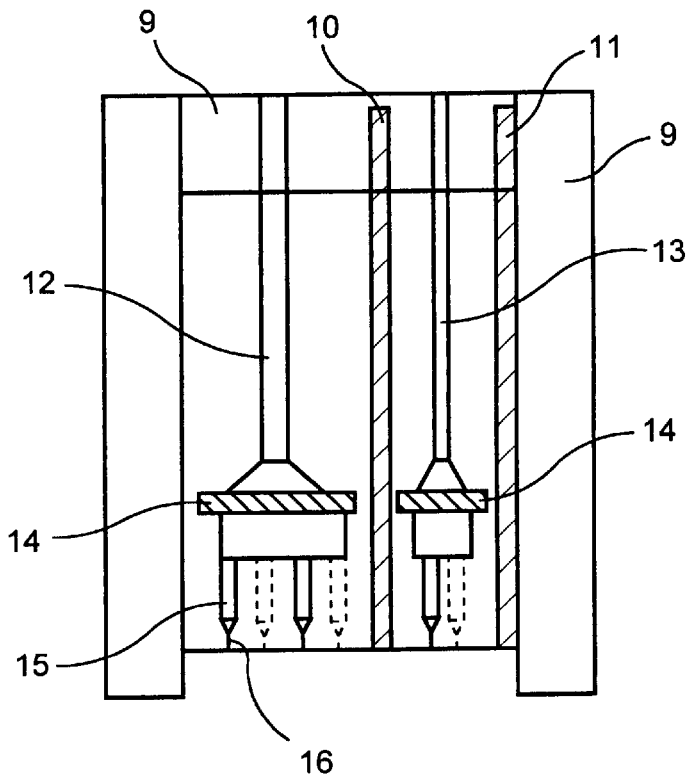
FIG. 4*a* shows a cross sectional view of a spinning nozzle.

For a rectangular nozzle shape according to FIG. 3*a*, cross section A—A is shown at the top of FIG. 4. This shows the heating box again as 9, plus insulation bores 10 and insulation gap 11. Insulation bores 10 separate melt channel 12 for the matrix component polymer from melt channel 13 for the binding component polymer. Just upstream from the orifice, each of the melts passes through a melt distributor screen 14 and then through a fore-bore for orifice capillary 16. The structural design for the melt control for the binding component is the same.

Figure 4B:
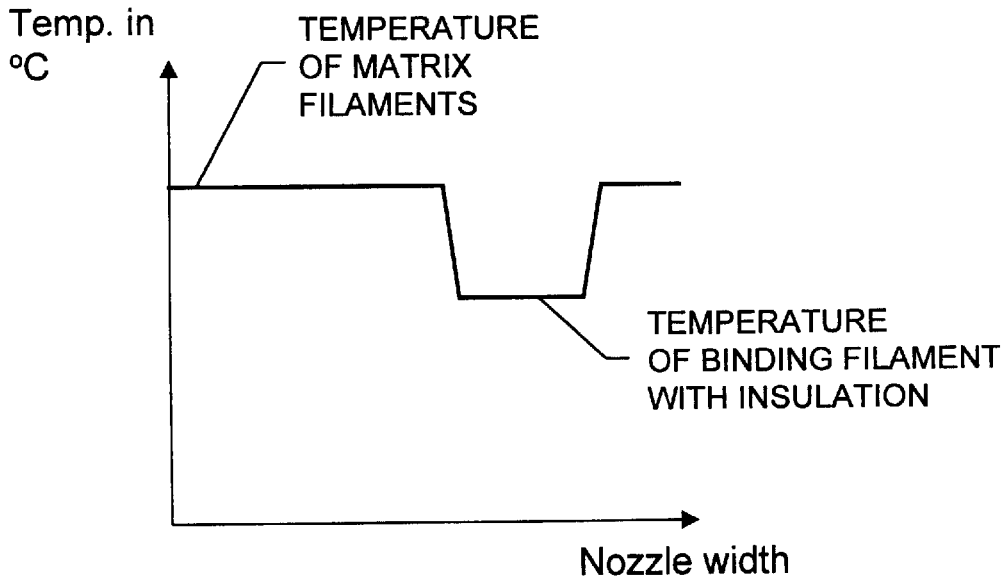
FIG. 4*b* shows the temperature profile over the cross section of the spinning nozzle shown in FIG. 4*a*.

FIG. 4*b* shows the temperature curve as a function of nozzle width with respect to the cross section shown above. There is clearly a sharp delineation between the temperature program for the matrix filaments and the temperature program for the binding filaments. Each melt thus has a temperature that is ideal for it.

Figure 5A:
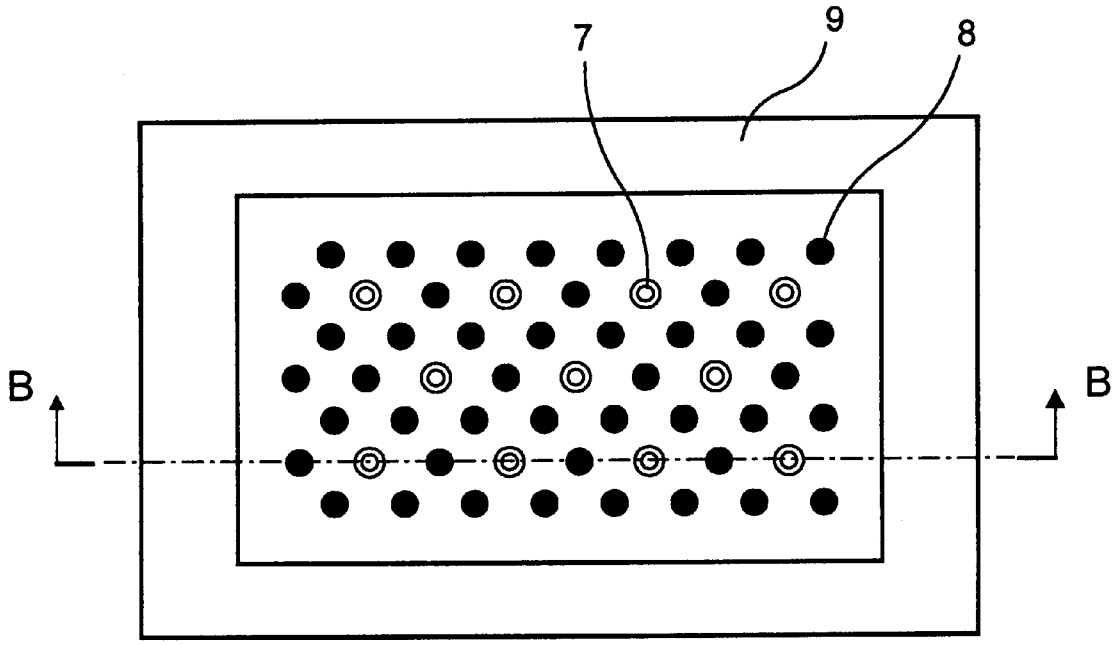
FIGS. 5*a* and 5*b* show a possible arrangement for melt control in a rectangular spinning nozzle pack, as seen from below (FIG. 5*a*) and in cross section (FIG. 5*b*).
Figure 5B:
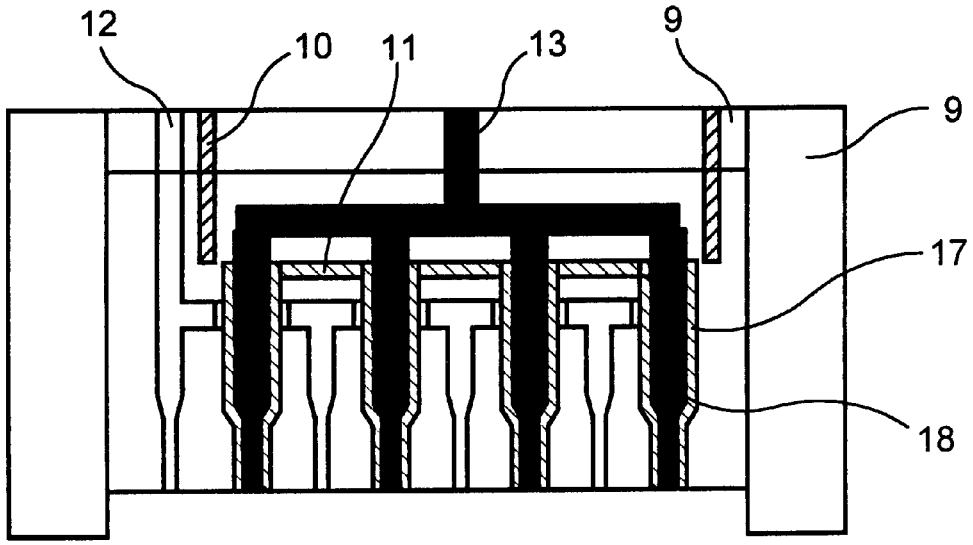

FIGS. 5*a* and 5*b* shows a possible arrangement for effecting melt control, here via a rectangular spinning nozzle pack 1. With an orifice arrangement according to FIG. 5*a*, the thermal separation of the polymers for the matrix filaments and the binding filaments is such that the binding filaments are each passed through cannulas 18. The latter are surrounded by an annular gap 17 (FIG. 5*b*) filled with air or insulation material. Insulation bores 10 and insulation gaps 11 are provided in the upper area of the channels. These relationships are shown in FIG. 5*b* on the basis of cross section B—B from FIG. 5*a*.

The following specific examples, which are not intended to limit the scope of the present invention in any way, show how the nozzle packs according to the present invention make it possible to fulfill all the requirements specified as the object of the present invention.

EXAMPLE 1

Using spinning nozzles of the design according to FIG. 2*a* in an arrangement according to FIG. 1, 120 filaments of polyethylene terephthalate and 60 filaments of a copolyester of polyethylene terephthalate are extruded. The melting range of the copolymer is around 180° C. The nozzle temperature for the polyethylene terephthalate is set at 290° C. and that for the copolymer is set at 270° C.

The control of the materials is selected so that the distribution of the resulting filaments is 90% polyethylene terephthalate and 10% copolyester. The polyethylene terephthalate fibers have a titer of 9 dtex.

The two sets of filaments are combined beneath the nozzle and after being drawn together in a drawing unit, they are deposited randomly on a screen-like conveyor belt moving horizontally. The resulting loose nonwoven is presolidified in a calender with two steel rolls under a pressure of 3 metric tons at a rate of 20 m/min, with the two rolls being heated to 120° C. The top roll has an engraved surface.

Then the nonwoven is sprayed with a finish containing silicone and finally solidified in a continuous oven at 195° C. by fusing the binding filaments.

The characteristics of the resulting nonwoven are as follows:

width of the nonwoven: 1.60 m weight of the nonwoven: 120 g/m$^2$ variation coefficient of surface mass: less than 5% (measured on a 10×10 cm square)

tensile strength in the longitudinal direction, untufted: 300 N/5 cm tested according to European Standard 290 73 T3 elongation at break in the longitudinal direction, untufted: 40% tested according to European Standard 290 73 T3 tensile strength in the transverse direction, untufted: 290 N/5 cm tested according to European Standard 290 73 T3 elongation at break in the transverse direction, untufted: 40% tested according to European Standard 290 73 T3 tear propagation resistance in the longitudinal direction: 160 N tested according to DIN 53,859, sheet 3

The following characteristics are obtained after tufting with an insertion density of 5/32":

tensile strength in the longitudinal direction, tufted: 270 N/5 cm tested according to European Standard 290 73 T3 elongation at break in the longitudinal direction, tufted: 50% tested according to European Standard 290 73 T3 tensile strength in the transverse direction, tufted: 210 N/5 cm tested according to European Standard 290 73 T3 elongation at break in the transverse direction, tufted: 50% tested according to European Standard 290 73 T3 tear propagation resistance in the longitudinal direction: 155 N tested according to DIN 53,859, sheet 3

EXAMPLE 2

Using spinning nozzles according to FIG. 2*c*, which form a nozzle group according to FIG. 1, 100 filaments of polyethylene terephthalate and 40 filaments of a polyethylene terephthalate copolymer whose melting range is around 225° C. are extruded. The nozzle temperature for the polyethylene terephthalate melt is 290° C., and that for the copolymer melt is 270° C. This yields filaments with a distribution of 75% polyethylene terephthalate and 25% polyethylene terephthalate copolymer. The titer of the polyethylene terephthalate filaments is 11 dtex.

The two sets of filaments per nozzle are combined and drawn together in the drawing unit. Then they are deposited on a screen-like conveyor belt moving horizontally. The resulting loose nonwoven is presolidified in a calender with two steel rolls under a pressure of 5 metric tons at the rate of 15 m/min. Both rolls are heated to 150° C., and one roll has an engraved surface. Final solidification of the nonwoven is performed in a continuous oven at 230° C., where the binding filaments are slightly fused.

The resulting nonwoven has the following characteristics:

width of the nonwoven: 1.01 m weight of the nonwoven: 230 g/m$^2$ variation coefficient of surface mass: less than 5% (measured on a 10×10 m square)

thickness: 0.95 mm tested according to ISO 9073-2 tensile strength in the longitudinal direction: 630 N/5 cm tested according to ISO 9073-3 elongation at break in the longitudinal direction: 32% tested according to ISO 9073-3 tensile strength in the transverse direction: 630 N/5 cm tested according to ISO 9073-3 elongation at break in the transverse direction: 32% tested according to ISO 9073-3 shrinkage in the longitudinal direction: 0.6% at 200° C. and 15 minutes shrinkage in the transverse direction: 0.6% at 200° C. and 15 minutes

EXAMPLE 3

Using spinning nozzles with the design shown in FIG. 3 in the arrangement according to FIG. 1, 200 filaments of polyethylene terephthalate and 90 filaments of a polyethylene terephthalate copolymer with a melting range around 165° C. are extruded. The nozzle temperature for the polyethylene terephthalate is 290° C. and that for the polyethylene terephthalate copolymer is 220° C.

Filaments with a distribution of 85% polyethylene terephthalate and 25% polyethylene terephthalate copolymer are obtained. The titer of the polyethylene terephthalate filaments is 7 dtex.

The two filament sets from each nozzle are combined and drawn together in a drawing unit. Then they are deposited on a screen-like conveyor belt moving horizontally. The resulting loose nonwoven is presolidified in a calender with two steel rolls under a pressure of 1.5 metric tons at a rate of 25 m/min. Both rolls are heated to 100° C., and the bottom roll has an engraved surface. Then the nonwoven is sprayed with a silicone finish and finally solidified in a continuous oven at 180° C. by softening the binding filaments.

The characteristics of the resulting nonwoven are as follows:

width of the nonwoven: 1.60 m weight of the nonwoven: 100 g/m$^2$ variation coefficient of the surface mass: less than 5% (measured on a 10×10 cm square)

tensile strength in the longitudinal direction, untufted: 200 N/5 cm tested according to European Standard 290 73 T3 elongation at break in the longitudinal direction, untufted: 31% tested according to European Standard 290 73 T3 tensile strength in the transverse direction, untufted: 180 N/5 cm tested according to European Standard 290 73 T3 elongation at break in the transverse direction, untufted: 35% tested according to European Standard 290 73 T3 tear propagation resistance in the longitudinal direction: 170 N tested according to DIN 53,589, sheet 3

The following characteristics are obtained after tufting with an insertion density of 5/32":

tensile strength in longitudinal direction, tufted: 250 N/5 cm tested according to European Standard 290 73 T3 elongation at break in the longitudinal direction, tufted: 65% tested according to European Standard 290 73 T3 tensile strength in the transverse direction, tufted: 180 N/5 cm tested according to European Standard 290 73 T3 elongation at break in the transverse direction, tufted: 65% tested according to European Standard 290 73 T3 tear propagation resistance in longitudinal direction: 250 N tested according to DIN 53,859, sheet 3

All three examples show that the spinning nozzles according to the present invention make it possible to produce mixtures of matrix filaments and binding filaments having a very thorough degree of mixing, even with significantly different titers. These options lead to very high strength values with the nonwovens treated in the manner described here.

What is claimed is:

1. A device for producing spunbonded nonwovens from a mixture of thermoplastic matrix filaments having a first, higher melting point and thermoplastic binding filaments having a second, lower melting point that is 5° C. to 50° C. lower than the first melting point, comprising:

a plurality of spinning nozzle packs, the nozzle packs each having a first group of melt channels and exit orifices for utilizing a thermoplastic polymer compound for forming matrix filaments and a second group of melt channels and exit orifices for utilizing a thermoplastic polymer compound for forming binding filaments; and a heating box surrounding each nozzle pack for heating the thermoplastic polymer compounds;

wherein the melt channels of the first group are thermally insulated from the melt channels of the second group, and each melt channel group is assigned an individual temperature which is sufficient to keep the respective polymer compound for the matrix filaments or for the binding filaments molten.

2. A device as set forth in claim 1, further comprising a plurality of air-filled cavities in between and running parallel to the melt channels of the first and second groups, thereby serving to thermally insulate the channels of the first group from the channels of the second group.

3. A device as set forth in claim 1, wherein the thermal insulation of the first and second groups of melt channels comprises a plurality of cavities in between the channels, running parallel to the channels and filled with a solid insulation material.

4. A device as set forth in claim 3, wherein the solid insulation material is a ceramic material or glass cloth mats impregnated with phenolic resin or epoxy resin and then cured.

5. A device as set forth in claim 1, wherein the cross section of the spinning nozzle packs is rectangular.

6. A device as set forth in claim 2, wherein the cross section of the spinning nozzle packs is rectangular.

7. A device as set forth in claim 3, wherein the cross section of the spinning nozzle packs is rectangular.

8. A device as set forth in claim 5, wherein the melt channels and their respective exit orifices are arranged in rows in the cross section of the spinning nozzle pack, separated according to the type of polymer they contain.

9. An apparatus as set forth in claim 6, wherein the melt channels and their associated exit orifices are arranged so they are uniformly interspersed in the cross section of the spinning nozzle packs.

10. A device as set forth in claim 1, wherein the cross section of the spinning nozzle packs is circular.

11. A device as set forth in claim 2, wherein the cross section of the spinning nozzle packs is circular.

12. A device as set forth in claim 3, wherein the cross section of the spinning nozzle packs is circular.

13. A device as set forth in claim 10, wherein the melt channels and their respective orifices of the first group are arranged concentrically with the melt channels and their respective orifices of the second group in the cross section of the spinning nozzle packs.

14. A device as set forth in claim 10, wherein the melt channels and their respective orifices of one group are arranged so they are randomly distributed with respect to the melt channels and the respective orifices of the second group in the cross section of the spinning nozzle packs.

15. A device as set forth in claim 9, wherein the polymer melt for the binder component is passed through a fore-bore and a capillary connected to it, passing in the lower area of the capillary through a cannula surrounded by an annular gap filled with air or a solid insulation material.

16. A device as set forth in claim 14, wherein the polymer melt for the binder component is passed through a fore-bore and a capillary connected to it, passing in the lower area of the capillary through a cannula surrounded by an annular gap filled with air or a solid insulation material.

17. A device for producing spunbonded nonwovens from a mixture of thermoplastic matrix filaments having a first, higher melting point and thermoplastic binding filaments having a second, lower melting point that is 5° C. to 50° C. lower than the first melting point, comprising:

a plurality of spinning nozzle packs, the nozzle packs each having a first group of melt channels and exit orifices for utilizing a thermoplastic polymer compound for forming matrix filaments and a second group of melt channels and exit orifices for utilizing a thermoplastic polymer compound for forming binding filaments wherein the cross section of the spinning nozzle packs is rectangular and each of the melt channels and their respective exit orifices are arranged in rows in the cross section of the spinning nozzle pack, separated according to the type of polymer they contain, the melt channels of the first group being thermally insulated from the melt channels of the second group, and each melt channel group being assigned to an individual temperature which is sufficient to keep the respective polymer compound for the matrix filaments or for the binding filaments molten; and a heating box surrounding each nozzle pack for heating the thermoplastic polymer compounds, wherein the melt channels for the binding component polymer are separated from the heating box surrounding the spinning nozzle pack by an insulation gap filled with air or a solid insulation material.

18. A device for producing spunbonded nonwovens from a mixture of thermoplastic matrix filaments having a first, higher melting point and thermoplastic binding filaments having a second, lower melting point that is 5° C. to 50° C. lower than the first melting point, comprising:

a plurality of spinning nozzle packs, the nozzle packs each having a first group of melt channels and exit orifices for utilizing a thermoplastic polymer compound for forming matrix filaments and a second group of melt channels and exit orifices for utilizing a thermoplastic polymer compound for forming binding filaments; and a heating box surrounding each nozzle pack for heating the thermoplastic polymer compounds;

wherein the melt channels of the first group are thermally insulated from the melt channels of the second group, and each melt channel group is assigned an individual temperature which is sufficient to keep the respective polymer compound for the matrix filaments or for the binding filaments molten, wherein the cross section of the spinning nozzle packs is circular, and the melt channels and their respective orifices of the first group are arranged concentrically with the melt channels and their respective orifices of the second group in the cross section of the spinning nozzle packs, wherein the melt channels for the binding polymer are in the interior with respect to the cross section of the spinning nozzle pack and are separated from the melt channels for the matrix polymer surrounding them concentrically by insulation bores which are also arranged concentrically.

* * * * *